US006029600A

United States Patent [19]

Davis

[11] Patent Number: 6,029,600

[45] Date of Patent: Feb. 29, 2000

[54] CLEAN HANDS ASSURED

[76] Inventor: Claude G. Davis, 726 Palmer Way, Melbourne, Fla. 32940

[21] Appl. No.: 09/197,817

[22] Filed: Nov. 23, 1998

[51] Int. Cl.[7] ..... B65D 83/14

[52] U.S. Cl. ..... 116/200; 116/211; 222/635

[58] Field of Search ..... 116/200, 201, 116/211; 222/180, 635, 402.1; 340/573.1

[56] References Cited

U.S. PATENT DOCUMENTS

| | | | |
|---|---|---|---|
| 3,273,756 | 9/1966 | Levy | 222/180 |
| 3,390,817 | 7/1968 | Heropoulos | 222/180 |
| 3,877,005 | 4/1975 | Apgar . | |
| 3,967,478 | 7/1976 | Guinn | 70/144 |
| 4,081,796 | 3/1978 | Tabron . | |
| 4,286,331 | 8/1981 | Anderson et al. . | |
| 4,649,397 | 3/1987 | Heaton et al. . | |
| 4,698,620 | 10/1987 | Marshall . | |
| 4,896,144 | 1/1990 | Bogstad . | |
| 5,202,666 | 4/1993 | Knippscheer . | |
| 5,610,589 | 3/1997 | Evans et al. . | |
| 5,734,325 | 3/1998 | Johnson et al. . | |

*Primary Examiner*—Andrew Hirshfeld
*Assistant Examiner*—Faye Francis
*Attorney, Agent, or Firm*—Brian S. Steinberger; Law Offices of Brian S. Steinberger

[57] ABSTRACT

A device for assuring that restroom users are effectively reminded to wash and cleanse their hands. A spray pump is attached adjacent to an exterior door-handle to a restroom and is activated either by the turning of the handle or by the opening of the door. The spray pump includes a spray nozzle which sprays the user's front palm and/or back of the hand with a dye stain when the door-handle is opened. The dye stain is non-toxic fast drying and easily washable with cleanser such as soap and water. The dye stain can be visible in natural light and include colors such as red, yellow, blue and the like. Alternatively, the dye stain can be only visible to infrared light. The device can be used with round circular door-handles and lever door-handles. A shield around the door handle can discourage attempts to defeat the staining.

13 Claims, 6 Drawing Sheets

CLEAN HANDS ASSURED

This invention relates to reminding restroom users to wash and cleanse their hands, and in particular to a device for releasing removable and quickly drying visible and infrared visible dye stain from a storage container through a tube to the hand of a user opening a doorknob to a restroom, after which the user can remove the stain by washing their hands with a cleanser.

BACKGROUND AND PRIOR ART

Restaurants and hospitals have statutory type hygiene requirements to have their staff and employees clean their hands after using restroom facilities. Often, restaurants and hospitals rely on an honor type system to remind the employees and staff to wash their hands. Also signs are used to remind users of the importance of cleaning their hands. Furthermore, hands that are apparently clean can carry germs. So that an individual disinclined to wash their hands after using a restroom will not ordinarily appear to have dirty hands. Many restroom users also ignore and forget the need to clean their hands. Furthermore, many restroom users only rinse their hands with water and no cleanser which is not adequate enough to clean off germs and bacteria.

Several U.S. patents have been proposed but fail to adequately solve the above problems. See for example U.S. Pat. Nos. 3,877,005 to Apgar; 3,967,478 to Guinn; 4,081,796 to Tabron; 4,286,331 to Anderson et al.; 4,649,397 to Heaton et al.; 4,698,620 to Marshall; 4,896,144 to Bogstad; 5,202,666 to Knippscheer; 5,610,589 to Evans et al.; 5,734,325 to Johnson et al.

U.S. Pat. No. 3,967,478 to Guinn describes an electronic device where a door can be opened by an electrically powered sensor that detects cleansing agent residue. Besides the need for an electrical power supply, the Guinn device does not require the user actually wash their entire hands with the cleansing agent since the user can allow a dab of cleanser on the back of one hand which can be picked up by the sensor. Merely ensuring the restroom user stood in front of a sink, ran water and even tapped the soap container does not mean they washed and cleansed both hands.

U.S. Pat. No. 4,896,144 to Bogstad describes an elaborate electronic "hand washing alert" device where visible and audible alarms remind persons using the restrooms to wash their hands. Obviously, the Bogstad device does not require persons to wash both hands.

U.S. Pat. No. 5,202,666 to Knippscheer describes another elaborate electronic system where persons wearing name tag transmitters/receivers enter washrooms and monitors detect the tag transmitters/receivers, and various bathroom devices such as sinks, hair dryers, soap dispensers etc.when used send signals to the tag transmitters/receivers. However, none of these sensors, transmitters, nor receivers actually require the person to wash both hands thoroughly. Persons, can merely turn on a sink and not wash their hands with the Knipscheer system.

U.S. Pat. No. 5,610,589 to Evans et al. describes another elaborate electronic tagging system where a worker's tag is light activated when they enter a washroom, and is only deactivated when a "gas" such as "alcohol" is emitted onto one's hands by by a "soap dispenser", which allows the tag light to be deactivated.

Other patents have been proposed for releasing dye type substances. See for example, U.S. Pat. Nos.: 3,877,005 to Apgar; 4,081,796 to Tabron; 4,649,397 to Heaton et al.; 4,698,620 to Marshall; and 5,734,325 to Johnson. However, these devices are directed to alarm type systems that release nonremovable dyes onto a person's hand for use as false fire alarm alert devices and theft prevention tags. These patents are directed toward applying a hard to remove permanent type marker to a person.

None of the patents described above would be useful to remind persons using restrooms to wash and cleanse their hands.

SUMMARY OF THE INVENTION

The first objective of the present invention is to provide a simple, efficient non-electrical device that effectively reminds users of restrooms to wash both of their hands.

The second object of this invention is to provide a non-electrical device that effectively reminds persons using restrooms to wash and cleanse both hands by releasing a washable non-toxic colored dye visible in natural daylight onto their hands when the persons enter the restrooms.

The invention assures that employees and users of restrooms in restaurants and hospitals and even other places of employment and the home, wash and cleanse their hands after using restrooms. The stain dye applied to the hand by operation of the door cannot be removed with water alone but is easily removed by washing with the cleanser supplied in the restroom. Only a telltale amount of stain is required, making it simple to accomplish instant drying so that clothing will not be stained. In the embodiments shown using standard door hardware, the stain is applied to the back of the hand, which is sufficient to ensure the thorough washing of both hands. Alternatively, the stain can be applied to the front of the hand as well. Only one hand needs to be stained since it is impossible to wash and cleanse only one hand at a sink.

A preferred embodiment of the invention includes a reservoir for storing a visible removable non-toxic dye mounted on a restroom door, a spray nozzle adjacent to an exterior door-handle of the restroom door that releases a portion of the visible dye onto a user's hand when the door-handle is operated to open the door so that the dye released on the user's hand can be washed off with cleanser applied to both hands.

The release mechanism for the dye can be either an aerosol spray can or a pump spray activated by the door-handle being turned or, if no latch is required, by the opening of the door itself. Any type of door-handle can be used, including a knob, crank or simple pull handle, so long as the hand must be positioned to receive the spray. Simple attempts to block the spray can be defeated by surrounding the handle by a shield which makes it difficult to insert paper or other materials between the spray and the hand.

Further objects and advantages of this invention will be apparent from the following detailed descriptions of presently preferred embodiments which are illustrated in the accompanying drawings.

DESCRIPTION OF THE PREFERRED EMBODIMENT

Before explaining the disclosed embodiments of the invention in detail it is to be understood that the invention is not limited in its application to the details of the particular arrangements shown since the invention is capable of other embodiments. Also, the terminology used herein is for the purpose of description and not of limitation.

Figure 1:
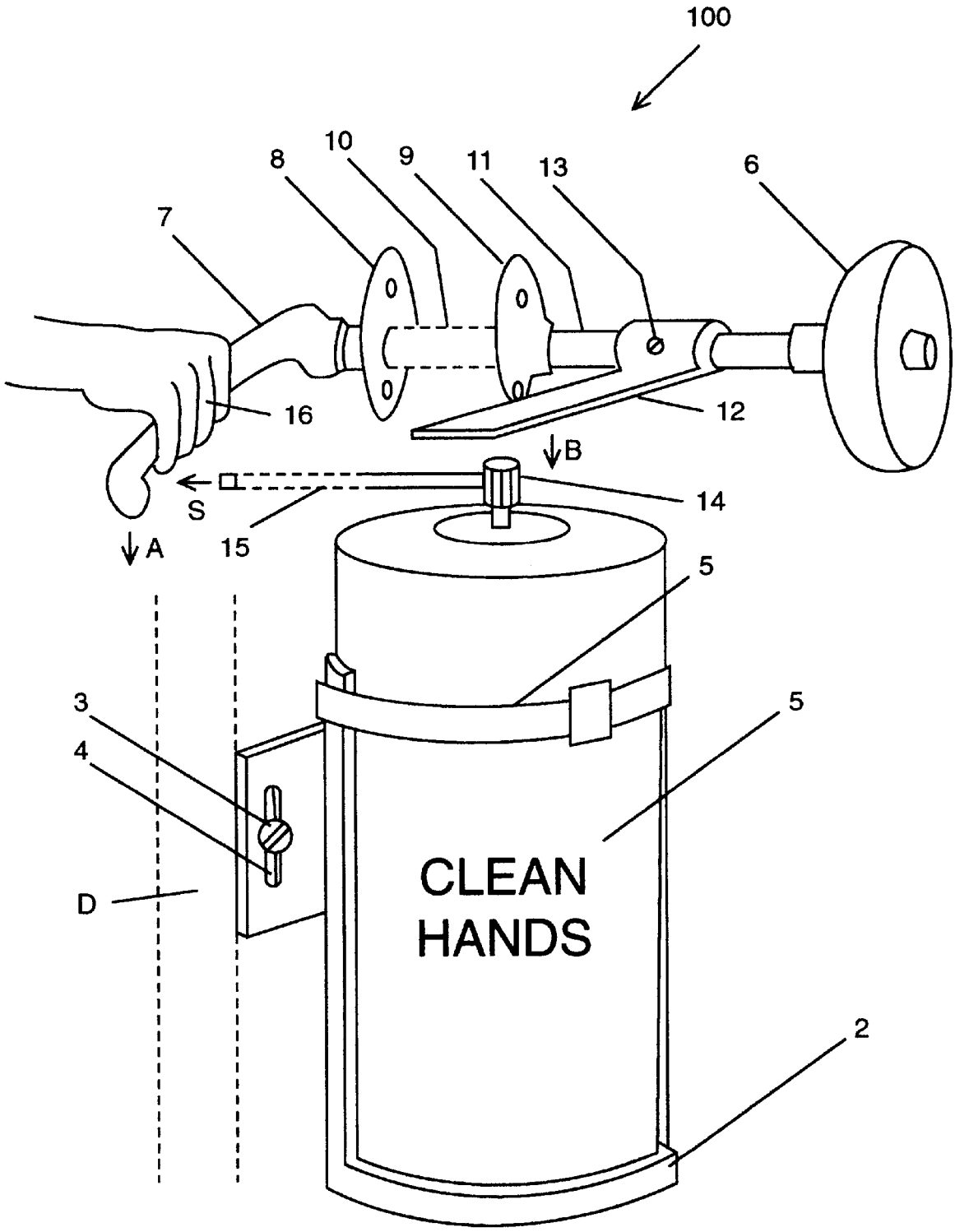
FIG. 1 is a perspective view of the first preferred embodiment using a crank door-handle and aerosol can of dye stain.

The first embodiment 100 of the invention is shown in FIG. 1. The staining fluid is contained in an aerosol spray can 1, which is mounted on a bracket 2 secured to the door D, by screws 3, utilizing the slots 4 to position the can vertically. The stain S, within can 1, can be a colored diluted food coloring having colors such as but not limited to red, yellow, orange, black, and the like, a washable face paint, and the like. Unlike the stains described in the background section of the invention, the stain S used in the invention must be easily washable, nontoxic, visible or all skin colors, and must not cause permanent stains on clothing. The can is held in place by strap 5. The interior door handle is knob 6 and the exterior handle is a crank type 7. Face plates 8 and 9 are part of a standard door hardware from Kwickset® and the like, holding the latch cylinder 10, which drives the latching mechanism (not shown). The latch cylinder 11 is extended if necessary on the interior of the door D, to permit attachment of the leaf spring 12 using the set screw 13. Turning the crank handle 7 in the direction of arrow A pushes down the free end of the leaf spring 12 in the direction of arrow B so that it depresses the spray can button 14 before the latch 10 releases and opens the door D. The stain S, is then directed through the door by tube 15 to the back of the hand 16. The leaf spring 12 is positioned so that it engages the spray can actuating button 14 just before the door latch is released so that the dwell time of the spring 12 will not be more than needed to stain the hand 16.

Figure 2:
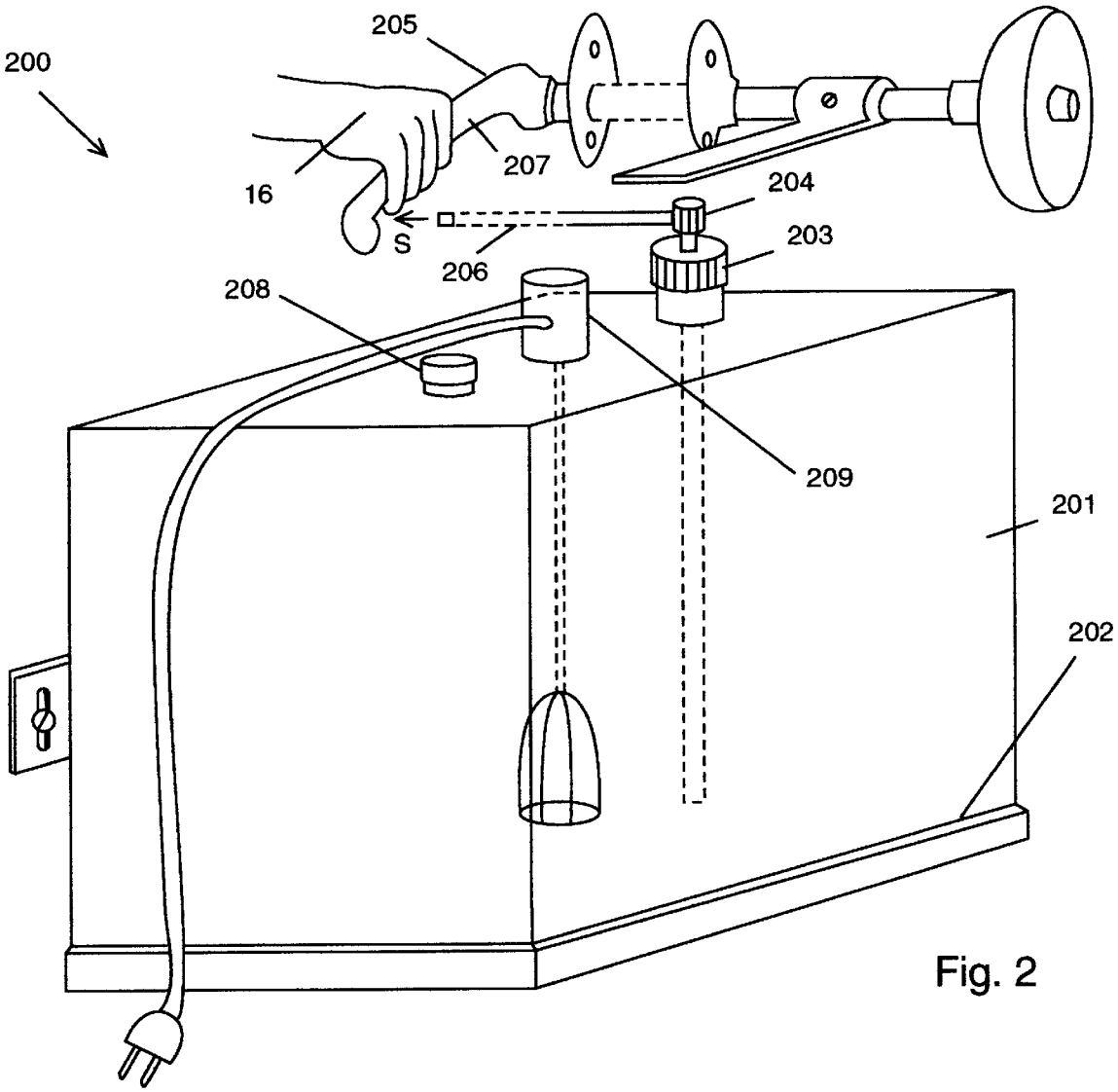
FIG. 2 is a perspective view of the second preferred embodiment using a crank door-handle and non-aerosol pump with a larger reservoir of stain.

The spray can embodiment, since it uses very little stain at each entry, will be satisfactory for many applications, especially in the home. For high traffic applications the spray can 1 may need to be changed too frequently and a larger reservoir of stain can be required. For these applications the pump spray embodiment shown in FIG. 2 is offered. In this implementation the actuating mechanism is identical to that of FIG. 1 but the spray can 1 is replaced by a non-aerosol spray pump 203 such as the pumps used for window cleaners, such as Windex®, and the like. As before, turning the crank of the door handle causes the leaf spring to depress the button of the spray pump in this case, directing the stain through the tube to the back of the hand 16.

In the FIG. 2 embodiment 200, the spray can 1 is replaced by a larger container 201 which is mounted on the door by a bracket 202, similar to that shown in FIG. 1. On the top of the container 201 is mounted a spray pump 203 of the type used in window cleaner bottles, except that the operating button 204 is on top of the pump. Operation is the same as in FIG. 1 in that turning crank 205 results in depression of the pump button 204, ejecting the stain S, through the tube 206 to spray the hand 207. The larger reservoir can be refilled through the capped opening 28. An optional 120 volt motor driven mixer 209 such as those found in kitchen appliance mixers including but not limited to those manufactured by Sunbeam®, can be used to mix the stain liquid inside.

Figure 3:
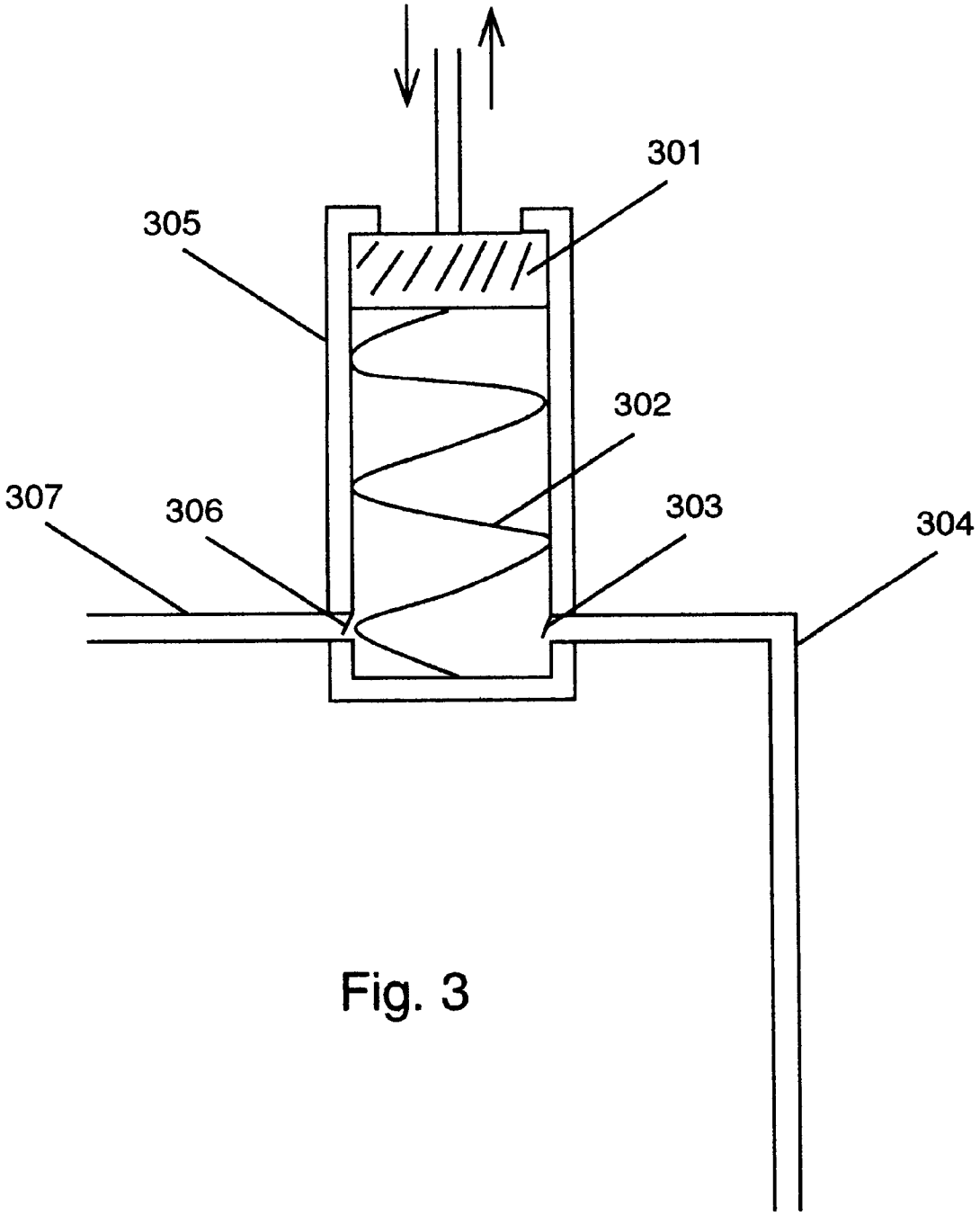
FIG. 3 is a cross-sectional view of a spray pump, included to show how the opening of the door itself to actuate the spray, rather than the operation of the latch.

A non-aerosol spray pump embodiment 204, 203 of FIG. 2 works on the principle shown in FIG. 3. The piston 301, when depressed the first time and released, is pushed by the spring 302 to create a vacuum which opens valve 303 to draw fluid through tube 304 from the reservoir to fill the cylinder 305. The next depression of the piston forces valve 306 to open, forcing the liquid out through tube 307. The spring 302 then pushes the piston 301 up to fill the cylinder 305 for the next operation. The amount of fluid ejected with each operation of the pump 301 is thus determined by the volume of the cylinder 305, which can be made small for this application.

Figures 4A, 4B:
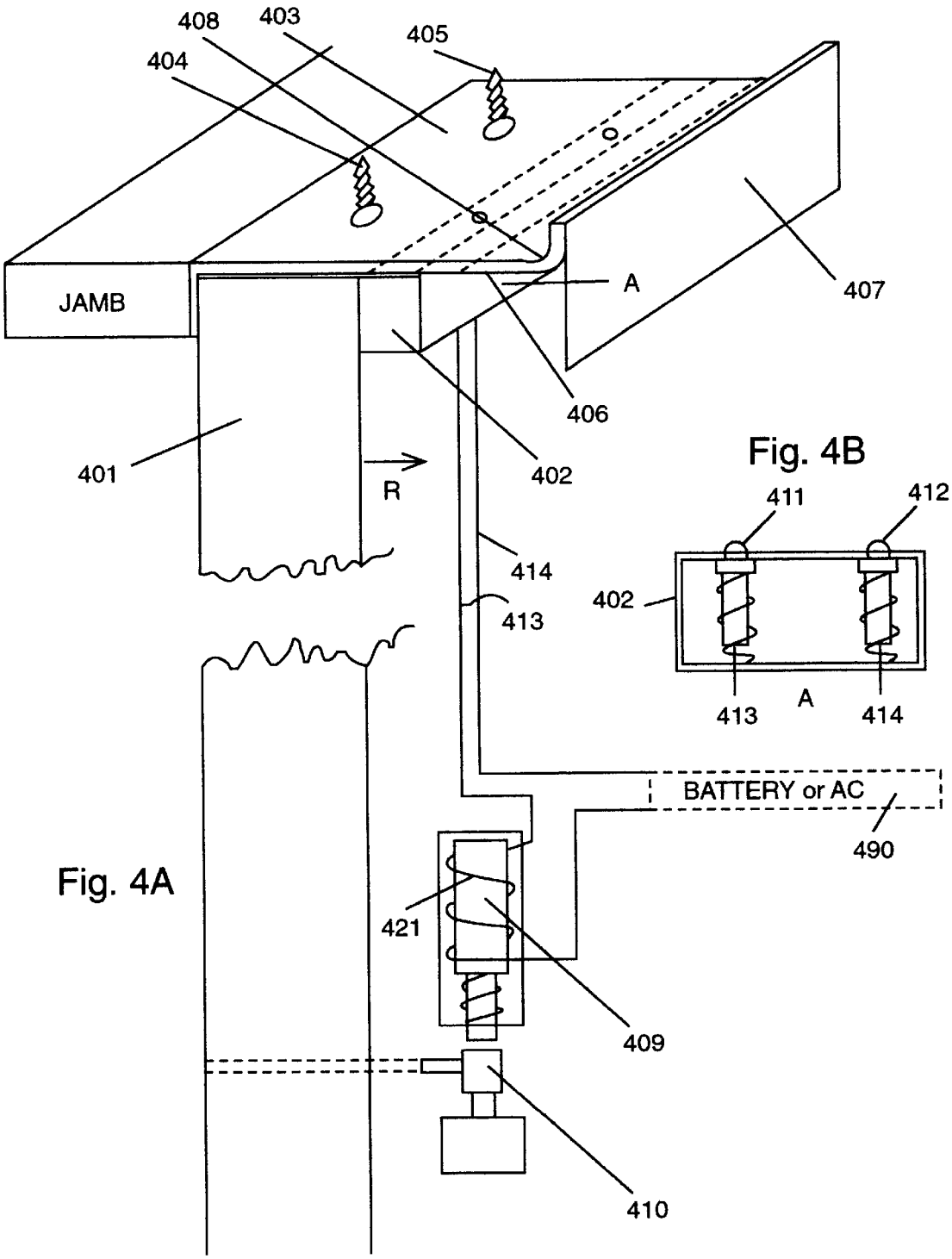
FIG. 4A is a perspective view of a third preferred embodiment using the opening of the door itself to actuate the spray, rather than the operation of the latch.
FIG. 4B shows the contact fixture 402 used in FIG. 4A.

FIG. 4A shows an embodiment 400 of the invention not using the door latches of the previous embodiments to release the stain. It is recognized that although a door latch can still be required to position the hand to receive the stain, providing for modification of a variety of door hardware can be cumbersome. Therefore the approach in FIG. 4A can be favored over those using door latches. Most restroom and bathroom doors open inward. Therefore, the door 401 in FIG. 4A opens to the right in the direction of arrow R. A contact fixture 402 can be mounted at the top of the interior side of the door 401. A brass plate 403 can be affixed to the top of the door frame 401 by brass screws 404, 405. The brass plate 403 can be covered with insulating plastic except at the strip 406 on the underside, which strip is exposed to directly reveal the conducting brass. The brass plate 403 also has a flexible insulating plastic apron 407 attached to its turned up outer edge 408. When the door 401 is opened slightly in the direction of arrow R, the contacts (411, 412 FIG. 4B) in fixture 402 wipe the conducting strip 406, completing the circuit to operate the solenoid 409 which depresses the trigger 410 of either an aerosol can or spray (previously described above) to stain the hand opening the door 401. As the door 401 continues to open, the solenoid circuit 409 is broken and the spray stops. When the door 401 closes, the apron 407 folds under the plate 403 to insulate the conducting strip 406 from the contact fixture 402. The spray is thus not actuated on closing the door.

FIG. 4B shows the contact fixture 402 used in FIG. 4A. The contacts 411 and 412 are rounded on the top and spring loaded 412 to push them into contact with the conducting strip 406. The leads 413 and 414 go to the solenoid and power supply battery or Alternating Current power supply 490. The solenoid 409 is also spring loaded 421 to keep it off the trigger 410 until it is energized by completion of the circuit.

Figure 5:
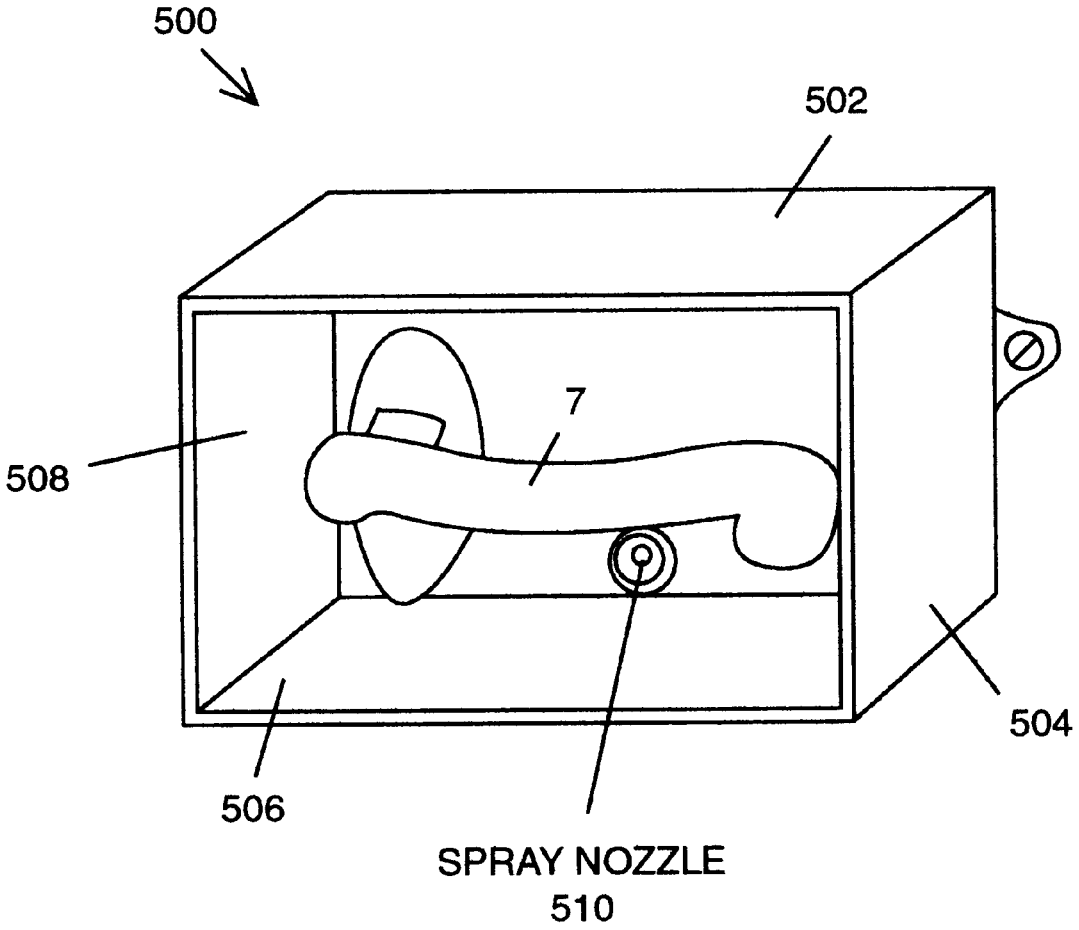
FIG. 5 is a perspective view of a shield to discourage attempts to defeat the spray.

FIG. 5 shows a simple shield 500 used for any of the door handles to discourage attempts to block the spray. In FIG. 5, shield 500 is shown having four sides 502, 504, 506, 508 surrounding the lever handle 7 forming an open sided box into which a user's hand is to be inserted.

Figure 6:
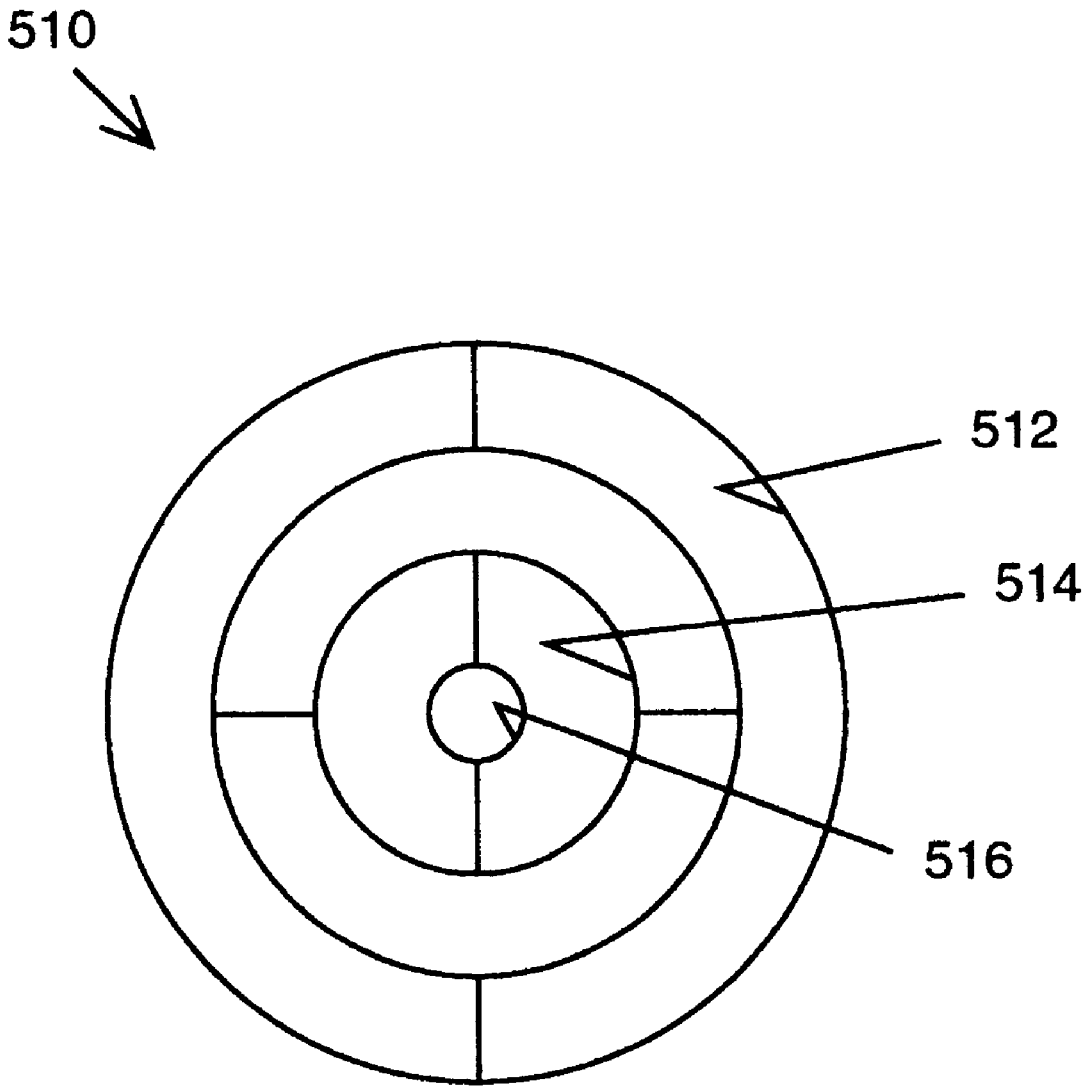
FIG. 6 is an enlarged front view of a print head that can be used with the spray nozzle of FIG. 5.

FIG. 6 is an enlarged front view of a print head 510 that can be used with the spray nozzle of FIG. 5. The head 510 can be formed from plastic connected concentric grids 512, 514, and 516, so that when used causes a "bulls eye" pattern to appear on the user's hand.

The stain used in this application has only the requirements that it not be easily removed with water alone, that it be quick drying, non-toxic, be visible on any skin color, not permanently stain clothing and that it be easily removed with the hand cleanser provided. If it is used in an aerosol can, it must be in solution, not in suspension, since the latter requires shaking of the can before use. The non-aerosol pump can use either type if it incorporates a mixer as shown in FIG. 2. The mixer would be running constantly to keep the stain in suspension.

The use of this invention in combination with automatic turn-on faucets, and hand air dryers assures that restroom users do not carry germs present in the restroom outside the restroom.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An apparatus for assuring that persons entering restrooms have cleaned their hands, comprising:

means for storing a visible removable non-toxic dye adjacent to a restroom door; and release means adjacent to an exterior door-handle of the restroom door that releases a portion of the visible dye towards the handle from the storing means when the door-handle is turned, said dye being washable with cleanser and not just with water.

2. The apparatus for assuring that persons entering restrooms of claim 1, wherein the removable non-toxic dye includes:

a colored non-toxic dye visible in natural light.

3. The apparatus for assuring that persons entering restrooms of claim 1, wherein the storing means include:

an aerosol pump.

4. The apparatus for assuring that persons entering restrooms of claim 1, wherein the release means includes:

a mechanical spray pump activated by the door-handle being turned.

5. The apparatus for assuring that persons entering restrooms of claim 4, wherein the door-handle includes:

a rotating lever.

6. The apparatus for assuring that persons entering restrooms of claim 4, wherein the door-handle includes:

a doorknob.

7. The apparatus for assuring that persons entering restrooms of claim 4, wherein the release means further includes:

a shield about the door-handle to discourage attempts to block the spraying of the dye.

8. The apparatus for assuring that persons entering restrooms of claim 4, further comprising:

a cover for covering a portion of a nozzle of the pump having a template opening for creating a selected dye shaped pattern onto the user's hand.

9. The apparatus for assuring that persons entering restrooms of claim 8, wherein the template includes:

cut-outs forming a pattern on the user's hand.

10. The apparatus for assuring that persons entering restrooms of claim 8, wherein the template includes:

grids forming a "bulls eye" pattern on the user's hand.

11. The apparatus for assuring that persons entering restrooms of claim 1, wherein the release means includes:

a mechanical spray pump activated by an opening of the door.

12. The apparatus for assuring that persons entering restrooms of claim 1, wherein the release means includes:

electrical contacts attached to the door which activate an electrically driven pump.

13. The apparatus for assuring that persons entering restrooms of claim 12, wherein the release means further includes:

a conductive plate having an exposed portion attached to a door frame above the door, so that the electrical contacts attached to a moving door rub against an exposed portion of the plate to complete an electrical circuit to activate the pump.

* * * * *